United States Patent [19]

Takeuchi et al.

[11] Patent Number: 4,918,969

[45] Date of Patent: Apr. 24, 1990

[54] FORGING METHOD FOR A HOLLOW ARTICLE

[75] Inventors: Hirosato Takeuchi; Yutaka Tanaka; Osahiko Miyazaki; Noboru Saito; Haruo Kubo; Naoyuki Kotake; Makoto Nagumo, all of Tokyo, Japan

[73] Assignee: Nitto Kohki Co., Ltd., Tokyo, Japan

[21] Appl. No.: 364,381

[22] Filed: Jun. 9, 1989

Related U.S. Application Data

[63] Continuation-in-part of Ser. No. 223,151, Jul. 22, 1988, abandoned.

[30] Foreign Application Priority Data

Jul. 22, 1987 [JP] Japan ..... 62-181233

[51] Int. Cl.[5] ..... B21D 28/32; B21J 5/12

[52] U.S. Cl. ..... 72/334; 72/333; 72/356; 72/377

[58] Field of Search ..... 72/334, 327, 356, 358, 72/377, 333, 328; 10/27 PH, 27 R; 29/874

[56] References Cited

U.S. PATENT DOCUMENTS

| | | | |
|---|---|---|---|
| 2,216,201 | 10/1940 | Keller | 10/27 PH |
| 4,352,283 | 10/1982 | Bailey | 72/377 |
| 4,416,141 | 11/1983 | Nippert | 72/356 |

FOREIGN PATENT DOCUMENTS

| | | | |
|---|---|---|---|
| 201326 | 12/1955 | Australia | 72/356 |
| 1527474 | 3/1970 | Fed. Rep. of Germany . | |
| 97838 | 7/1980 | Japan | 72/356 |
| 145326 | 8/1983 | Japan | 72/334 |

OTHER PUBLICATIONS

*Industrieanzeiger*, No. 12, p. 22, Mar. 12, 1982.

*American Machinist*, p. 139, July 20, 1953.

*Primary Examiner*—Daniel C. Crane

*Attorney, Agent, or Firm*—Nixon & Vanderhye

[57] ABSTRACT

A forging method comprises the following four steps: a first step of disposing a columnar material into a first die and extruding one end portion of the material with a first punch in a direction opposite to the advancing direction of the first punch, a second step of deepending a first blind hole in a second stepped die with a cavity having large and small internal diameter portions, and extruding the other end portion of the material into the inside of the small internal diameter portion of the cavity with a second punch which has been previously extended thereinto, a third step of fitting the first and second blind holes to third punches while exposing the small outer diameter portion from a third die and pressurizing, by means of a sleeve, only an end face portion of the small outer diameter portion formed with the second blind hole to expand the small outer diameter portion of the material toward an outer periphery, and a fourth step of punching out a blind portion of the material.

4 Claims, 3 Drawing Sheets

FORGING METHOD FOR A HOLLOW ARTICLE

RELATED APPLICATION

This application is a Continuation-in-Part of application Ser. No. 07/223,151 filed July 22, 1988, now abandoned.

BACKGROUND AND SUMMARY OF THE INVENTION

1. Field of the Invention

The present invention relates to a forging or heading method for hollow articles, which is suitable for providing plastic processed hollow articles having a circumferential groove formed in its outer surface.

2. Description of the Related Art

In producing a hollow article having a circumferential groove formed in the outer surface and a through hole formed at the center, like the one shaped as shown in, for example, in FIG. 6, a conventional manufacturing process involves a cutting process.

In forming a circumferential groove in the outer surface of a columnar material by cutting work, however, excessive processing time is needed, reducing the productivity. As well, cutting wastes or chips are produced, reducing the yield and deteriorating the working environment.

SUMMARY OF THE INVENTION

It is an object of this invention to provide a forging method for a hollow article which has a significantly shorter processing time, which yields higher productivity, which requires no cutting work, and which prevents degradation of the working environment.

This object can be achieved by a forging method for a hollow article, which comprises four steps, namely:

a first step of disposing a columnar material into a first stepped die with a cavity having large and small internal diameter portions and extruding one end portion of the material with a first punch in a direction opposite to an advancing direction of the first punch to thereby form a first blind hole in the center portion of said material;

a second step of deepening the first blind hole in a second stepped die with a cavity having large and small internal diameter portions and a stepped portion until the hole reaches the proximity of the stepped portion, and extruding the other end portion of the material into the inside of the small internal diameter portion of the cavity with a second punch previously extended thereinto to thereby simultaneously form a stepped portion at the middle section of said material and a small outer diameter portion ad a second blind hole at the other end portion thereof while leaving a blind portion between the first and second blind holes;

a third step of fitting the first and second blind hole to third punches while exposing the small outer diameter portion of said stepped material from a third die and pressurizing, by means of a sleeve, only the end face portion of the small outer diameter portion formed with the second blind hole to expand the small outer diameter portion of the stepped material toward the outer periphery, thereby forming a circumferential groove between the expanded portion and the stepped portion of the stepped material; and a fourth step of punching out the blind portion between said first and second blind holes of the stepped material to cause the first and second blind holes to communicate with each other.

According to the forging method of this invention, a hollow article having an annular groove formed in the outer surface can be formed through a forging method which begins by forming a first tubular portion with a first blind hole at the front end portion of a columnar material. A second tubular portion having a relatively small diameter and with a second blind hole at the rear end portion while leaving a blind portion between the first and second blind holes. The second tubular portion is then expanded and deformed in an outwardly radial direction to form an annular groove in that outer surface portion of the material which corresponds to the blind portion. Finally, the blind hole is punched out to form a through hole.

This significantly shortens the overall processing time of production of hollow articles as compared with the time required using the cutting work. This considerably improves the productivity of hollow articles. In addition, because of the elimination of cutting work, the yield is significantly higher and degradation of the working environment due to the otherwise possible generation of chips can be prevented.

DETAILED DESCRIPTION OF THE PREFERRED EMBODIMENT

An embodiment of this invention will be explained below referring to the accompanying drawings.

FIGS. 1A through 6 illustrate one embodiment of this invention, with FIGS. 1A to 5B illustrating essential portions of a die used for the individual steps.

Figure 1A:
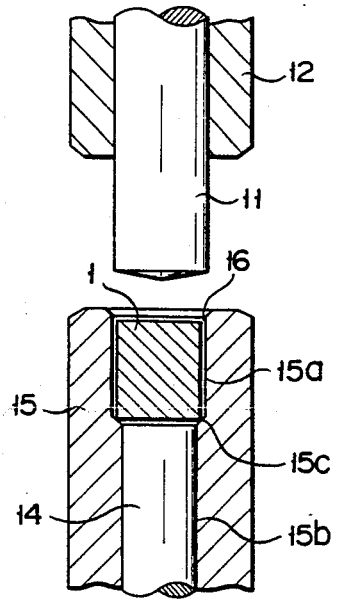
FIGS. 1A and 1B are cross sectional views of a forging apparatus illustrating the preliminary step of a forging method according to this invention.
Figure 1B:
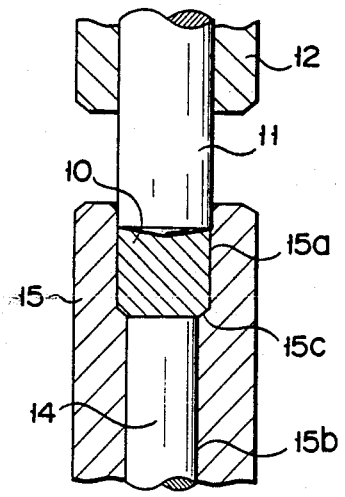

FIGS. 1A and 1B illustrate the preliminary step, and the forging apparatus used to realize the forging method of this invention. This apparatus comprises a front punch 11, a sleeve 12, a rear punch 14 and stepped die 15. Sleeve 12 is disposed concentrically over the outer surface of front punch 11. Stepped die 15 is disposed concentrically over the outer surface of rear punch 14, has a mold activity defining inner wall **15*a* defining a die cavity 16 between front punch 11, rear punch 14 and a through hole 15*b* in which the rear punch 14 is inserted, and further includes stepped portion 15*c* formed between inner wall 15*a* and through hole 15*b***.

Figure 2A:
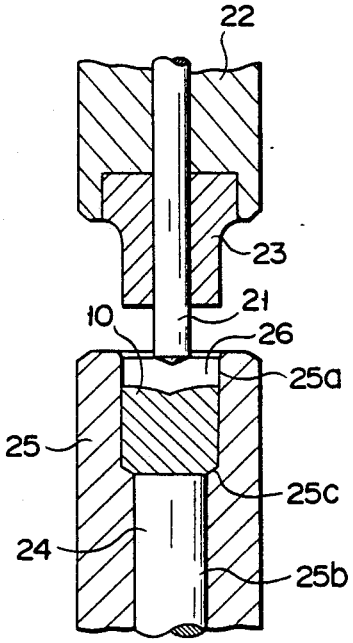
FIGS. 2A and 2B are cross sectional views of the forging apparatus, illustrating the first step of the forging method according to this invention.
Figure 2B:
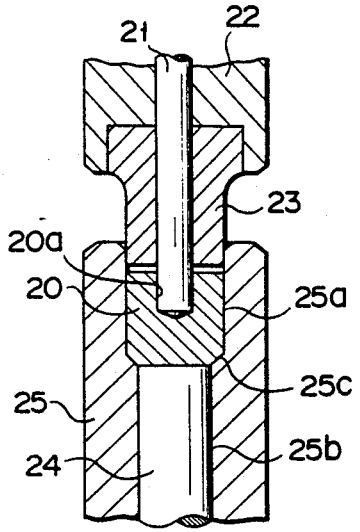

FIGS. 2A and 2B illustrate the first step of the forging method according to this invention. The forging apparatus used in this step comprises a front punch 21 and a sleeve 22 which is disposed concentrically over the outer surface of front punch 21. A material pressing member 23 is disposed concentrically over the outer surface of front punch 21 at one end of sleeve 22. This forging apparatus further comprises a rear punch 24 and a stepped die 25, which is disposed concentrically over the outer surface of rear punch 24, has an inner wall 25*a* that defines a die cavity 26 between the front punch 21 and rear punch 24. A stepped portion 25*c* is formed between inner wall 25*a* and through hole 25*b*.

Figure 3A:
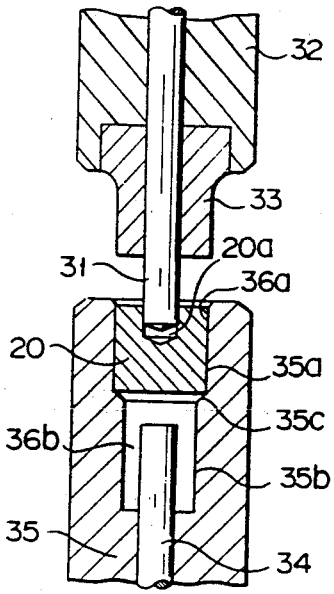
FIGS. 3A and 3B are cross sectional views of the forging apparatus illustrating the second step of the forging method.
Figure 3B:
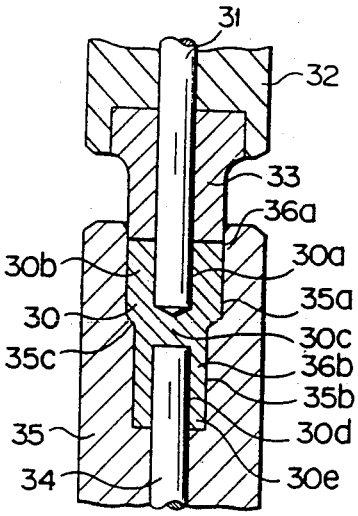

FIGS. 3A and 3B illustrate the second step. The forging apparatus used in this step comprises a front punch 31 and a sleeve 32 which is disposed concentrically over the outer surface of front punch 31. A material pressing member 33 is disposed concentrically over the outer surface of front punch 31 at one end of sleeve 32. This pressing deformation apparatus further comprises a rear punch 34 and a stepped die 35. This die 35 is disposed concentrically over the outer surface of rear punch 34, has a large inner wall 35*a*, which defines a large diameter die cavity 36*a* in the proximity of an opening portion of die 35, and further includes a small inner wall 35*b*, which defines a cylindrical small diameter die cavity 36*b* in cooperation with rear punch 34. A stepped portion 35*c* is formed between large inner wall 35*a* and small inner wall 35*b*.

Figure 4A:
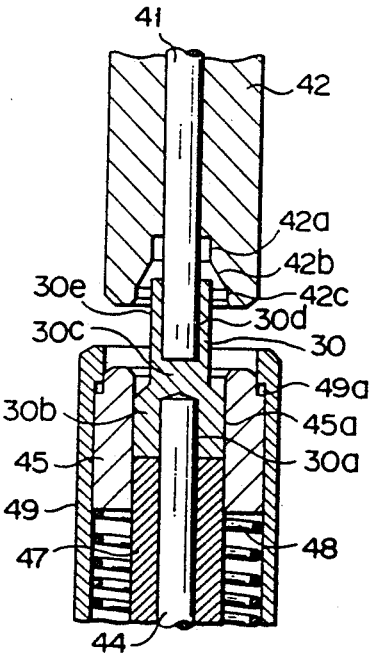
FIGS. 4A and 4B are cross sectional views of the forging apparatus illustrating the third step.
Figure 4B:
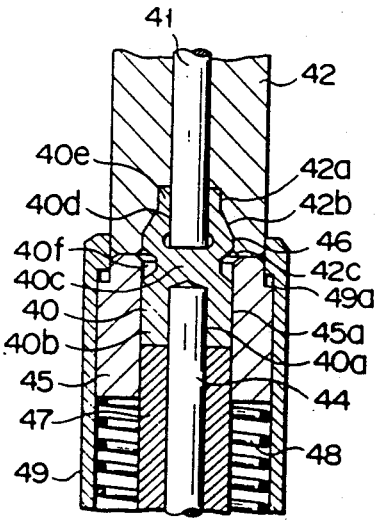

FIGS. 4A and 4B illustrate the third step. The forging apparatus used in this step comprises a front punch 41 and a sleeve 42, which is disposed concentrically over the outer surface of front punch 41, has a small inner wall 42*a*, a conical inclined face 42*b* both for restricting the movement of a material, and a large inner wall 42*c* that defines a die cavity 46. This forging apparatus further comprises a rear punch 44 and a material supporting sleeve 47, which is disposed concentrically over the outer surface of rear punch 44. A die 45 is disposed concentrically over the outer surfaces of rear punch 44 and sleeve 47, is always pushed by a compression coil spring 48, and has a large inner wall 45*a*, which restricts the movement of the material. A casing 49 is provided with an inner collar portion 49*a* that guides die 45 and restricts the movement of the die 45 caused by coil spring 48.

Figure 5A:
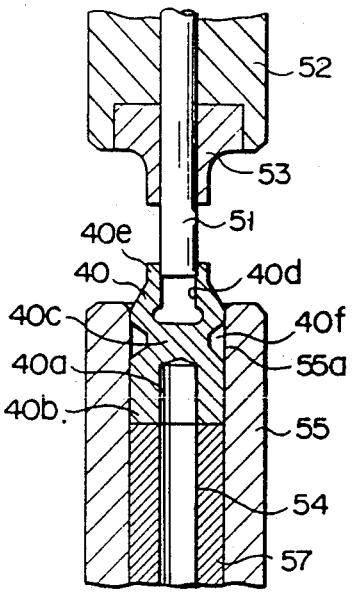
FIGS. 5A and 5B are cross sectional views of the forging apparatus illustrating the fourth step.
Figure 5B:
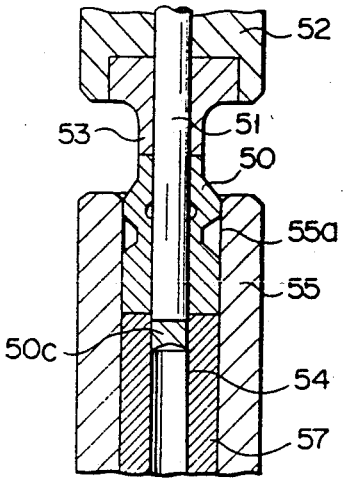

FIGS. 5A and 5B illustrate the fourth step. The forging apparatus used in this step comprises a front punch 51 and a sleeve 52 which is disposed concentrically over the outer surface of front punch 51. A hollow-article pressing member 53 is disposed concentrically over the outer surface of front punch 51 at one end of sleeve 52. This forging apparatus further comprises a rear punch 54 and a material supporting sleeve 57, with a discharge hole 54 through which a cutaway piece 50*c*, cut by front punch 51, is discharged. A die 55 is disposed concentrically over the outer surfaces of rear punch 54 and sleeve 57 and has an inner wall 55*a* that restricts the movement of material.

Figure 6:
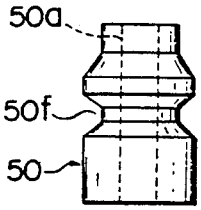
FIG. 6 is a side view illustrating one mode of a hollow article.

The following describes the procedures for manufacturing a hollow article 50, which has a through hole 50*a* at the center portion and a circumferential groove 50*f* in the outer surface, as shown in FIG. 6.

In the preliminary step shown in FIGS. 1A and 1B, columnar material 1, provided by cutting a rod material, for example, with a given size as shown in FIG. 1A, is disposed in cavity 16 of stepped die 15. Front punch 11 and sleeve 12 are moved to compress columnar material 1 (see FIG. 1A) as shown in FIG. 1B, thereby providing heading material 10 that is plastically deformed to have the same shape as the cavity of stepped die 15. This material 10 is taken out by moving front punch 11 and sleeve 12 in the reverse direction and moving rear punch 14 forward.

In the first step shown in FIGS. 2A and 2B, material 10 prepared in the preliminary step is disposed in die cavity of another stepped die 25 (see FIG. 2A). Front punch 21, sleeve 22 and material pushing member 23 are moved to push one end of the material 10 backward, thereby providing blind hole material 20 with a first blind hole 20*a* formed at this end. Then, front punch 21 is alone withdrawn from blind hole material 20 and the free end of rear punch 24 is moved forward beyond the opening of stepped die 25 to remove the material 20.

In the second step shown in FIGS. 3A and 3B, blind hole material 20 prepared in the first step is disposed in large diameter die cavity 36*a* in third stepped die 35 from the other end i.e., the end where the first blind hole 20*a* is not formed, as shown in FIG. 3A. At the same time, front punch 31, sleeve 32 and material pressing member 33 are moved to push backward blind hole material 20 from one end surface thereof, thereby deepening the blind hole 20*a* until it reaches the proximity of stepped portion 35*c* of die 35. As a result, a first blind hole 30*a* is formed and annular portion 30*b* is formed in large die cavity 36*a*. At the same time, or slightly afterward, this material 20 is pushed backward by rear punch 34, previously extended into die 35. This provides a cylindrical portion 30*e* having a second blind hole 30*d* at the inner wall, and leaves a blind portion 30*c* between first and second blind holes 30*a* and 30*d* within small diameter die cavity 36*b*, thereby providing stepped material 30 as shown in FIG. 3B.

Then, after front punch 31 is withdrawn from first blind hole 30*a*, sleeve 32 and material pushing member 33 and rear punch 34 are moved forward to remove stepped material 30 from die 35.

In the third step shown in FIGS. 4A and 4B, stepped material 30 prepared in the second step is turned upside down in the diagrams and is in this state fit through material restricting face 45*a* of die 45 from the end face of annular portion 30*b* formed with first blind hole 30*a*. And, first blind hole 30*a* is fitted over rear punch 44 to restrict the inner and outer surfaces of annular portion 30*b*, i.e., the surface of first blind hole 30*a* and the outer surface of stepped material 30. Subsequently, as also shown in FIG. 4A, front punch 41 is fitted in second blind hole 30*d* of cylindrical portion 30*e*, thereby restricting the inner wall of cylindrical portion 30*d* or the outer surface of this portion 30*d*. Sleeve 42 is then moved to pressurize the end face portion of cylindrical portion 30*e*. During the pressurizing action, the free end portion of cylindrical portion 30*e* is restricted between small inner wall 42*a* formed in sleeve 42 and front punch 41. Annular die cavity 46 is formed between conical inclined face 42*b* and large inner wall 42*c* continuous to small inner wall 42*a* of sleeve 42 and the outer surface of cylindrical portion 30*e*. Blind portion 30*c* is left at the base of cylindrical portion 30*e* in stepped material 30. Therefore, the movement of sleeve 42 causes plastic deformation along conical inclined face 42*b* formed in sleeve 42, over the region from the restricted free end portion of cylindrical portion 30*e* to the unrestricted portion thereof. As a result, a cylindrical portion 40*e* having the shape as shown in FIG. 4B can be provided. Since it is more difficult to plastically deform blind portion 30*c* than cylindrical portion 30*e*, a circumferential groove 40*f* is formed at that outer surface of cylindrical portion 40*e* which corresponds to blind portion 40*c* (30*c*), thus providing material 40 with a groove as shown in FIG. 4B.

According to this embodiment, die 45 is always pressed by compression coil spring 48 and the amount of movement of sleeve 42 suitable for plastic deformation of cylindrical portion 30*e* can be properly adjusted.

After the formation of grooved material 40, front punch 41 is alone withdrawn from cylindrical portion 40*e*. Sleeve 42 is then moved backward and rear punch 44 is moved to remove annular portion 40*b* from die 45, thus taking out grooved material 40.

In the fourth step shown in FIGS. 5A and 5B, grooved material 40 prepared in the third step is put through material restricting face 55*a* of die 55 and material supporting sleeve 57 is fitted to the opening portion of first blind hole 40*a* of annular portion 40*b*, as shown in FIG. 5A. Then, as shown in FIG. 5B, front punch 51 is moved to cut blind portion 40*c*, and the resultant cutaway piece 50*c* is discharged through discharge hole 54 to thereby form through hole 50*a* at the center of grooved material 40.

Through the aforementioned first to fourth steps, hollow article 50 (see FIG. 6) having through hole 50*a* at the center and circumferential groove 50*f* at the outer surface thereof can be provided.

Although the foregoing description illustrates the step-by-step formation of hollow article 50 from columnar material 1 through five steps, actually, the individual steps are executed in parallel; in the preliminary step, front punch 11 reciprocates to prepare columnar material 1 while in the fourth step front punch 51 reciprocates to complete hollow article 50.

What is claimed is:

1. A forging method for a hollow article having a peripheral groove, comprising the steps of:

a first step of disposing a columnar material into a first stepped die with a cavity having large and small internal diameter portions and extruding one end portion of said material with a first punch in a direction opposite to an advancing direction of said first punch to thereby form a first blind hole in the center portion of said material;

a second step of deepening said first blind hole in a second stepped die with a cavity having large and small internal diameter portions and a stepped portion until the hole reaches the proximity of the stepped portion, and extruding the other end portion of said material into the inside of said small internal diameter portion of said cavity with a second punch previously extended thereinto to thereby simultaneously form stepped material having a large outer diameter portion and a small outer diameter portion with a stepped portion therebetween and a second blind hole at said other end portion thereof while leaving a blind portion between said first and second blind holes;

a third step of fitting said first and second blind holes to third punches while exposing in an unsupported manner the outer periphery of the small outer diameter portion of said stepped material from a third die and pressurizing, by means of a sleeve, only an end face portion of said small outer diameter portion formed with said second blind hole to expand said small outer diameter portion of said stepped material toward the outer periphery to form an expanded portion, thereby forming a peripheral groove between said expanded portion and the stepped portion of said stepped material; and a fourth step of punching out said blind portion between said first and second blind holes of said stepped material to cause said first and second blind holes to communicate with each other.

2. The method according to claim 1, wherein in said third step, in pressurizing, by means of said sleeve, only said end face portion of small outer diameter portion of said material formed with said second blind hole, an inner wall of said second blind hole is restricted by one of said third punches.

3. The method according to claim 1, wherein in said third step, in pressurizing, by means of said sleeve, only said end face portion of small outer diameter portion of said material formed with said second blind hole, an inner wall of said second blind hole is restricted by one of said third punches, and an outer surface of said end face portion of said small diameter portion is restricted by said sleeve with a cavity which produces said expanded portion and corresponding to the shape of a forging article.

4. The method according to claim 1, wherein said stepped material put through said second step is turned up side down and is then disposed in said third die in said third step.

* * * * *